United States Patent [19]

Thomas et al.

[11] Patent Number: 4,941,601

[45] Date of Patent: Jul. 17, 1990

[54] CAP DRIER AND SHAPER

[76] Inventors: Ronald K. Thomas; Judith A. Thomas, both of 1850 U.S. Hwy. 27 South, Avon Park, Fla. 32825

[21] Appl. No.: 394,475

[22] Filed: Aug. 16, 1989

[51] Int. Cl.[5] ..... A42C 1/00

[52] U.S. Cl. ..... 223/24; 2/171

[58] Field of Search ..... 2/192, 171.3, 425, 172, 2/177, 195, 209, 171, 410, 411; 223/24, 25, 26, 20, 21, 22, 23

[56] References Cited

U.S. PATENT DOCUMENTS 1,111,363 9/1914 Chiniquy et al. ..... 223/24
3,348,239 10/1967 Lamour ..... 2/171.3
4,434,514 3/1984 Sundahl et al. ..... 2/171.3 X
4,551,858 11/1985 Pasternack ..... 2/171.2 X

FOREIGN PATENT DOCUMENTS 0052067 5/1982 European Pat. Off. ..... 2/425

*Primary Examiner*—Andrew M. Falik
*Attorney, Agent, or Firm*—Warren D. Flackbert

[57] ABSTRACT

A cap drier and shaper which achieves effectiveness is reconditioning a soiled fabric cap. The drier and shaper is presented in the form of a continuous side wall blending into a crown, a bill extending from the continuous side wall, and a cut-out area in the continuous side wall beneath the bill, the latter permitting a stacking relationship. The unit is fabricated and/or molded from a lightweight plastic resin and may include ventilating ports in the crown.

2 Claims, 1 Drawing Sheet

CAP DRIER AND SHAPER

As is known, the usage of caps is widespread, extending, for example, to working, identification, pleasure, and decorative reasons. Such type of cap is typically made from a fabric and includes a forwardly extending bill which is customarily reinforced for utility purposes. A difficulty presented by the preceding cap is in connection with washing, where nothing is currently available to assure the drying of a cap in an unwrinkled condition and, as well, to maintain the cap shape close to that of its original state of appearance.

BACKGROUND OF THE INVENTION

The invention satisfies the aforesaid need in presenting a cap drier and shaper which effectively receives a cap after washing and permits the ready drying thereof in a shape maintaining condition. Briefly, the device presented herein is made from a lightweight molded plastic resin; may include ventilation ports to expedite drying; and, is arranged to permit stacking for ready storage and/or transporting.

BRIEF DESCRIPTION OF THE FIGURES

A better understanding of the present invention will become more apparent from the following description, taken in conjunction with the accompanying drawing; wherein.

Figure 1:
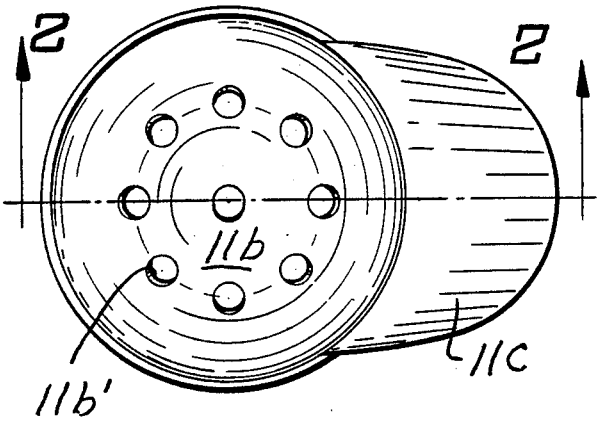
FIG. 1 is a top plan view showing a cap drier and shaper in accordance with the teachings of the present invention.
Figure 2:
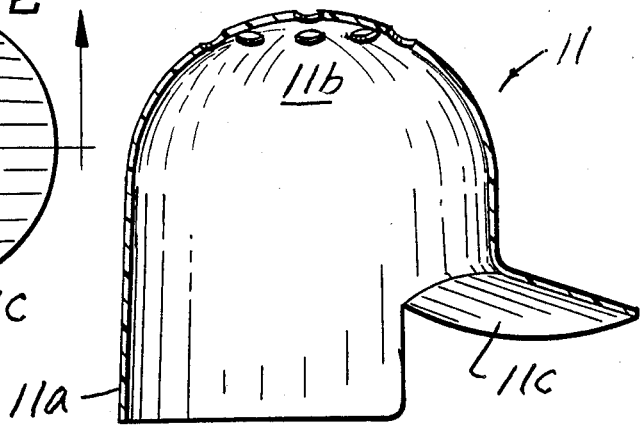
FIG. 2 is a view in vertical section, taken at lines 2—2 on FIG. 1 and looking in the direction of the arrows, detailing the invention.

For the purposes of promoting an understanding of the principles of the invention, reference will now be made to the embodiment illustrated in the drawing and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF A PREFERRED EMBODIMENT

Referring now to the figures, the cap drier and shaper of the invention includes a body portion 11 defined by a continuous side wall 11*a* terminating in a crown 11*b*. The cap drier and shaper further includes a forwardly extending bill 11*c*, assuming the shape commonly found on a cap of this type.

Figure 3:
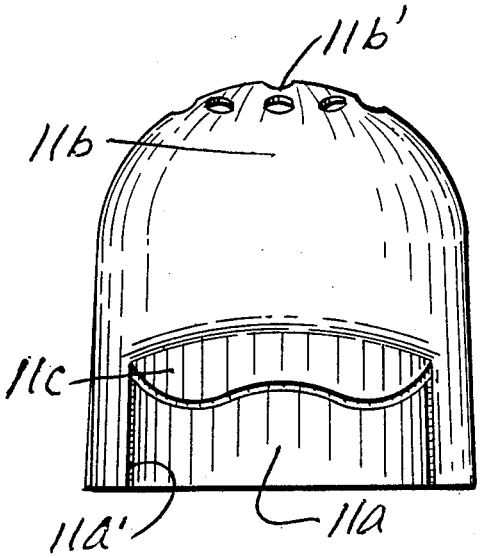
FIG. 3 is a view in front elevation, looking from left to right in FIG. 2, further detailing the invention; and, FIG. 4 is a view in side elevation of the instant cap drier and shaper, with a phantom showing of other units during a stacking procedure.

The crown 11*b* optionally includes perforations 11*b'* for air passage, where the continuous side wall 11*a* tapers slightly outwardly towards the free bottom edge thereof (see FIG. 3) to assure ease in stacking. The instant drier and shaper is typically molded from a light weight plastic resin.

Figure 4:
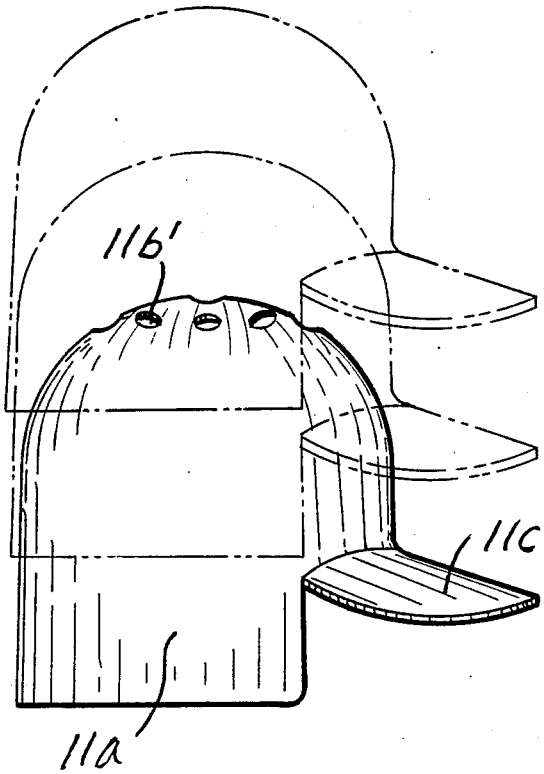

FIG. 4 illustrates a stacking relationship of cap driers and shapers where, importantly, it should be noted that a cut-out area 11*a'* is presented beneath the bill 11*c* in the continuous side wall 11*a*. The latter serves to achieve compact stacking, e.g. even closer than that shown in FIG. 4.

When used, a soiled cap is readily placed on the cap drier and shaper where, during drying, the possibility of wrinkling is minimized and where the drying cap is maintained in its general original shape. In this connection, the bill 11*c* plays importance, supporting a portion of cap which is generally heavier than the remainder. As stated, usage of the perforations 11*b'* serves to further promote air circulation and cap drying and shaping.

It should be evident, therefore, that the invention presents a readily available cap drier and shaper which is readily stored and/or transported; which is usable at various locations, as at home and/or when traveling; and, which represents rigidity but, at the same time, lightness in weight.

The cap drier and shaper disclosed herein is susceptible to various changes within the spirit of the invention, including, by way of example, in proportioning; the selection of material from which the cap drier and shaper is molded or fabricated; the optional use of the aforesaid perforations; and, the like. Thus, the preceding should be considered illustrative and not as limiting the scope of the following claims:

We claim:

1. In combination a fabric cap and a cap drier and shaper comprising a continuous side wall blending into a crown, and a bill extending outwardly from and above a free edge of said continuous side wall, where a cut-out area in said continuous side wall beneath said bill serves a stacking relationship, and where said fabric cap overlies said continuous side wall, said crown and said bill in a drying and shaping relationship.

2. The cap and cap drier and shaper of claim 1 where said continuous side wall tapers slightly outwardly in the direction of said free edge thereof.

* * * * *